US007789803B2

(12) United States Patent
Plante et al.

(10) Patent No.: US 7,789,803 B2
(45) Date of Patent: Sep. 7, 2010

(54) FRAMELESS TRAMPOLINE

(75) Inventors: Thomas M. Plante, Woodbury, MN (US); Patrick Golden, Mahtomedi, MN (US)

(73) Assignee: Revel Match LLC, St. Paul, MN (US)

( * ) Notice: Subject to any disclaimer, the term of this patent is extended or adjusted under 35 U.S.C. 154(b) by 0 days.

(21) Appl. No.: 12/418,932

(22) Filed: Apr. 6, 2009

(65) Prior Publication Data

US 2009/0258760 A1 Oct. 15, 2009

Related U.S. Application Data

(60) Provisional application No. 61/044,127, filed on Apr. 11, 2008.

(51) Int. Cl.
*A63B 21/00* (2006.01)

(52) U.S. Cl. ..... 482/27; 482/28

(58) Field of Classification Search ..... 482/27, 482/28

See application file for complete search history.

(56) References Cited

U.S. PATENT DOCUMENTS

| | | | | |
|---|---|---|---|---|
| 317,231 | A * | 5/1885 | Smith | 24/320 |
| 1,456,168 | A | 5/1923 | Witmer et al. | |
| 3,047,294 | A * | 7/1962 | Maxwell | 482/27 |
| 3,095,947 | A | 7/1963 | Beaulaurier | |
| 4,331,329 | A | 5/1982 | Mirkovich et al. | |
| 4,478,420 | A | 10/1984 | Sowards | |
| 4,576,375 | A | 3/1986 | Roberts | |
| 4,598,904 | A | 7/1986 | Roth | |
| 5,299,989 | A | 4/1994 | Boyd | |
| 5,385,518 | A * | 1/1995 | Turner | 482/27 |
| 5,810,695 | A | 9/1998 | Sass | |
| 5,967,943 | A | 10/1999 | Rich | |
| 6,017,292 | A * | 1/2000 | Gift et al. | 482/27 |
| 6,036,620 | A | 3/2000 | Yang | |
| 6,264,583 | B1 | 7/2001 | Rich | |
| 6,319,174 | B1 | 11/2001 | Alexander | |
| 6,447,426 | B2 | 9/2002 | Peterson | |
| 6,508,682 | B1 | 1/2003 | Clark | |
| 6,582,264 | B2 | 6/2003 | Brown | |
| 6,923,744 | B2 | 8/2005 | Chen | |

OTHER PUBLICATIONS

Jump 'N. Fun product literature (1 page) (prior to Sep. 2003).
Wrightsmarine.net webpage depicting MAXXON trampoline (1 page) Aug. 23, 2000.

* cited by examiner

*Primary Examiner*—Jerome Donnelly
(74) *Attorney, Agent, or Firm*—Allison Johnson; Allison Johnson, P.A.

(57) ABSTRACT

A floatable trampoline that includes a floatable support, an apron attached to the floatable support, a mat, a first connector attached to the mat, a second connector attached to the apron, and springs, wherein at least one spring is attached to at least one first connector and at least one second connector so as to couple the mat to the apron.

13 Claims, 7 Drawing Sheets

FRAMELESS TRAMPOLINE

CROSS-REFERENCE TO RELATED APPLICATIONS

This application claims the benefit of U.S. Provisional Application No. 61/044,127 filed Apr. 11, 2008, and incorporated herein.

BACKGROUND

The invention relates to maintaining a tensioned jump surface on a trampoline.

Trampolines are available in various constructions. Some trampolines include metal frames for support of the trampoline on land. Other trampolines are capable of floating on water and typically include a continuous floatable tube for supporting the trampoline. Regardless of the support configuration, the trampoline usually includes a trampoline mat attached to a rigid metal frame through metal springs. The metal springs hold the trampoline mat taught and provide additional bounce to the user of the trampoline. The rigid metal frame provides the support necessary to maintain a proper amount of tension on the trampoline mat and to allow the mat to flex and spring back without the entire apparatus caving in upon itself. The rigid metal frame is usually made out of steel and is rather bulky and heavy.

A number of bounce apparatuses have been constructed in which there are no springs for holding the mat and there is no frame. Such bounce apparatuses are often referred to as "springless trampolines," even though they lack the performance of a typical trampoline. One springless trampoline construction is a floatable bounce apparatus that includes an inflated tube, an apron attached to the tube, individual loops of woven webbing stitched to the apron and a bounce mat that includes individual loops of woven webbing stitched to the bounce mat. The mat is secured to the tube by placing the mat loops and the apron loops in an alternating relationship with one another, feeding a cord through the alternating apron loops and mat loops, and tightening the cord to fix the bounce mat in place. In such an apparatus, the close inter-relationship between the interdigitated loops functions to substantially evenly distribute the torsional tension that occurs during use across the entire length of the tube. An example of such bounce apparatus is disclosed in U.S. Pat. No. 6,659,914. Such bounce apparatuses lack the spring back, i.e., recoil and snap action, typically associated with backyard or commercial trampolines containing springs. Thus bounce performance is severely sacrificed.

SUMMARY

The invention features a floatable trampoline in which the mat, i.e., jump surface, is maintained in position on the trampoline through a coupling to a floatable support.

In one aspect, the invention features a floatable trampoline that includes a floatable support, an apron attached to the floatable support, a mat, a first connector attached to the mat, a second connector attached to the apron, and springs, wherein at least one spring is attached to at least one first connector and at least one second connector so as to couple the mat to the apron. The mat of the floatable trampoline is free of a connection to a rigid frame.

The invention features a trampoline that includes a jump surface that attaches directly to a support through springs without the need for the rigid frame (often made of metal, plastic or a carbon fiber composite) that is traditionally used to maintain the jump surface under tension and to secure the jump surface to the support, i.e., the trampoline can be constructed to be free of a rigid metal frame.

Other features and advantages will be apparent from the following description of the drawings, the preferred embodiments, and from the claims. In the figures, like numbers are used to represent like elements.

DETAILED DESCRIPTION

Figure 1:
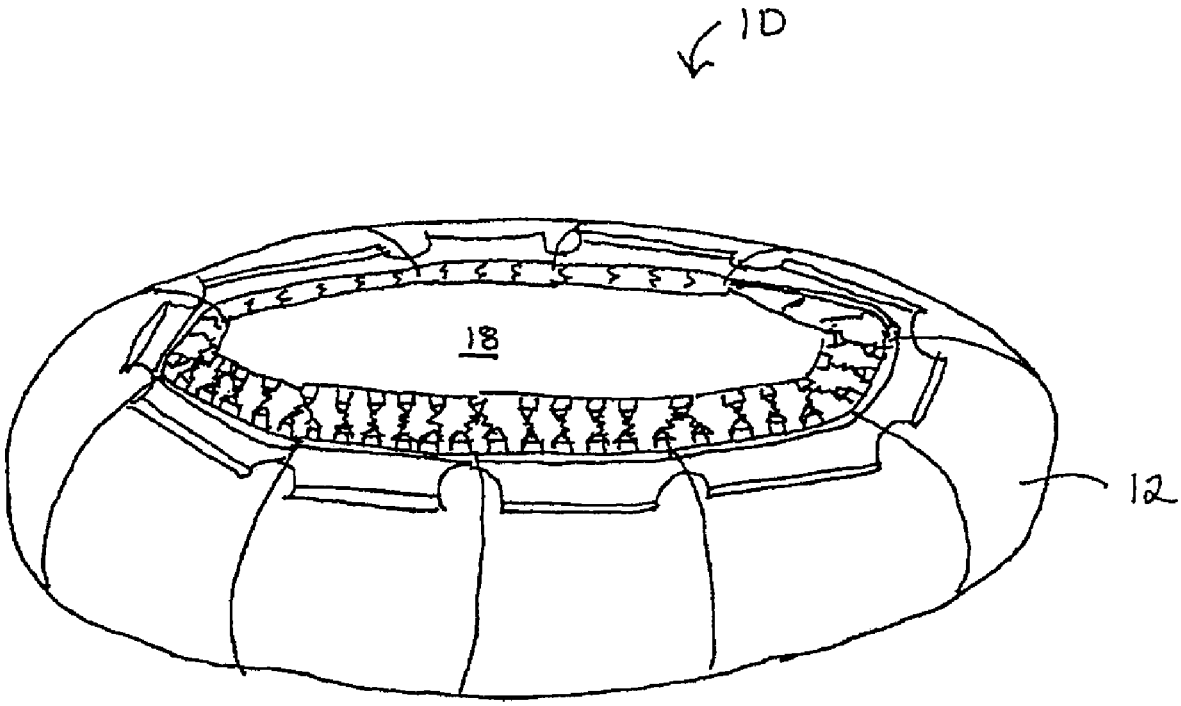
FIG. 1 is a perspective view of a trampoline according to one embodiment.
Figure 2:
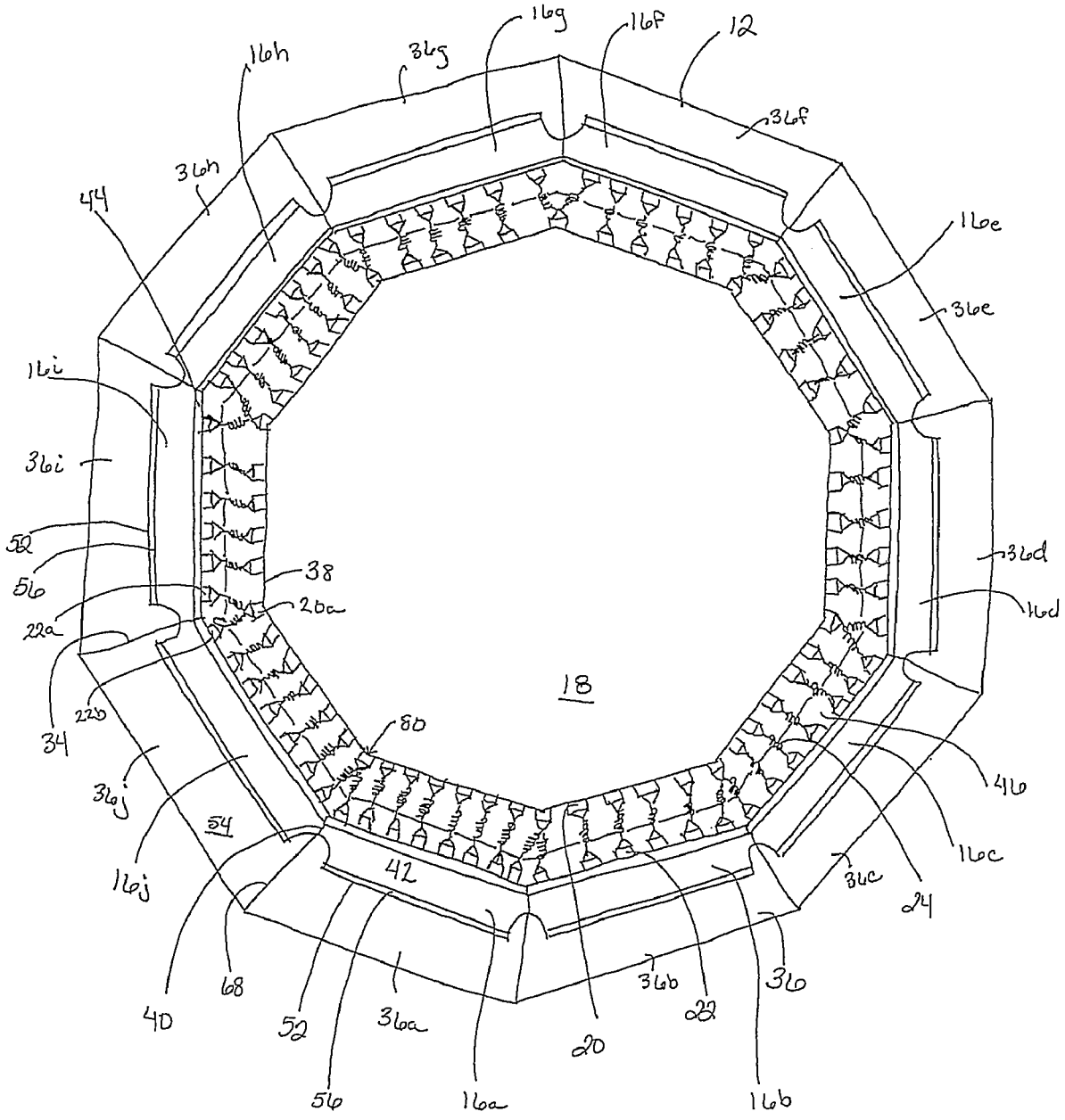
FIG. 2 is a top view of the trampoline of FIG. 1.
Figure 3:
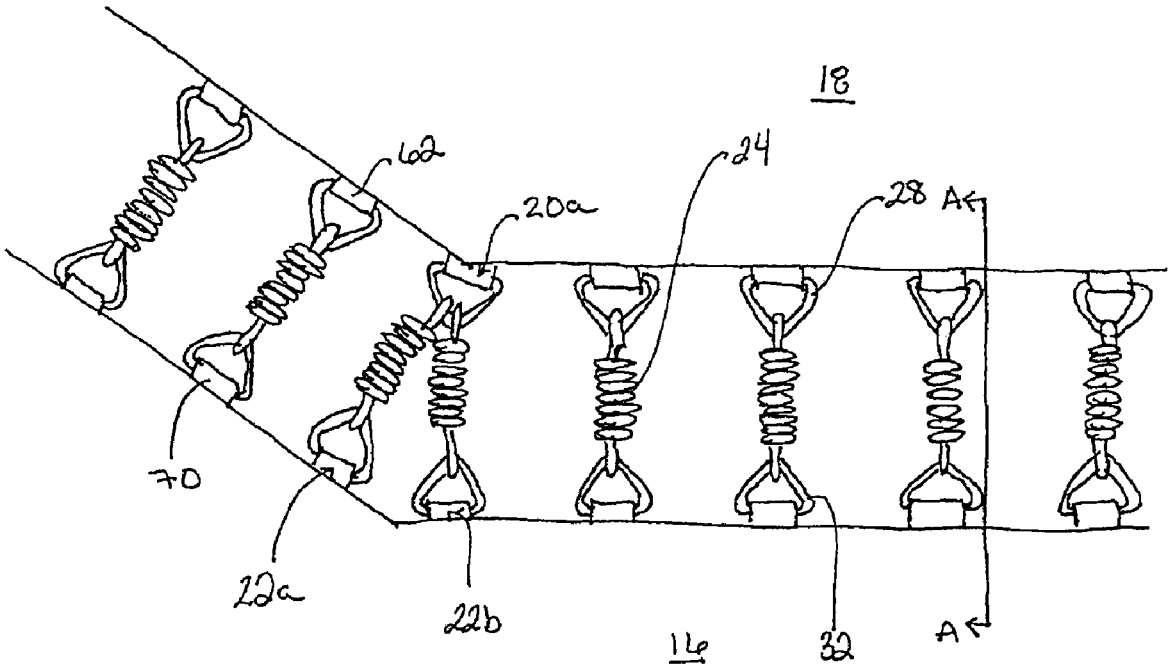
FIG. 3 is an enlarged top view of the connection between the apron and the mat of the trampoline of FIG. 1.
Figure 4:
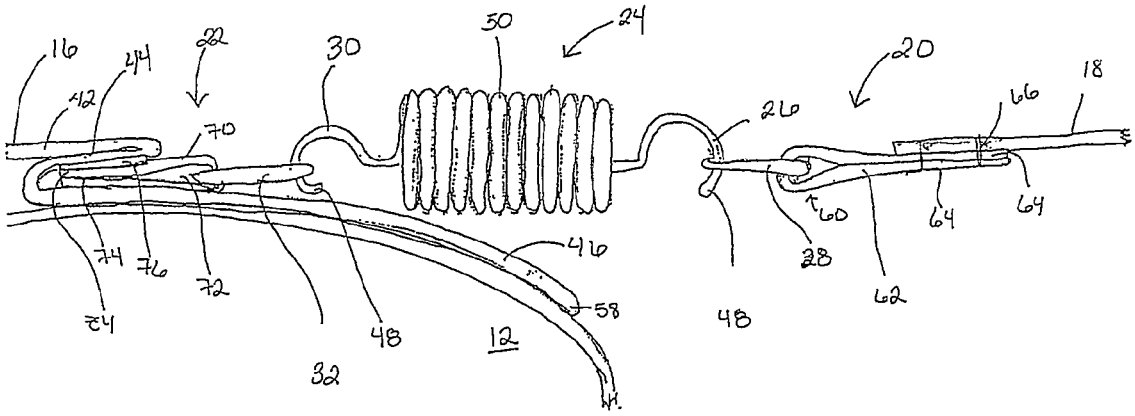
FIG. 4 is an enlarged view taken in cross section along line A-A of FIG. 3.

FIGS. 1-4 illustrate a trampoline 10 that includes a floatable support 12, an apron 16 attached to the support 12, a mat 18 extending across the opening defined by the support 12, mat connectors 20, apron connectors 22, and springs 24. The mat connectors 20 are spaced at intervals along the mat 18 and the apron connectors 22 are spaced at intervals along the apron 16. The mat connectors 20 include a strap 62 that has been threaded through a triangular ring 28, around one side of the ring 28, and folded over upon itself to form a loop 60. The ends 64 of the strap 62 of the mat connectors 20 are attached to the mat 18.

The apron connectors 22 also include a strap 70 that has been threaded through a triangular ring 32, around one side of the ring 32, and folded over upon itself to form a loop 72. The ends 74 of the strap 70 of the apron connector 22 are attached to a reinforcing strap 76 and to the apron 16. The straps 62, 71 used to form the mat and apron connectors 20, 22, can be made from any suitable material including, e.g., woven webs and polymer impregnated webs.

The mat connectors 22 are positioned along the extent of the side edge of the mat 18 so as to align with corresponding apron connectors 22 positioned on the apron 16. The triangle rings 28 of the mat connectors 20 also align with the triangle rings 32 of the apron connectors 22. For mats 18 having multiple straight sides, two apron connectors 22 positioned nearest the apron union 40 are preferably coupled to a single mat connector 20 positioned at a corner 80 formed by two edges 38 of the mat 18, through their respective springs 24. Such a configuration enables a more uniform force to be exerted on the mat 18, the apron 16, and the underlying segment 36 of the support 12.

Springs 24 couple the mat 18 to the apron 16 and maintain the mat 18 in position within the opening defined by the support 12. The springs 24 include a first end 26 that hooks around a triangle ring 28 attached to the mat connector 20 and a second end 30 that hooks around the triangle ring 32 of the apron connector 22. The apron connectors 22*a*, 22*b* nearest the union 34 formed by two segments 36 of the support 12 connect to the mat connector 20*a* at the corner 80 formed by edges 38 of the mat 18. The length of the spring, the spring material, the number of springs, inflated diameter and material of the inflatable support, and the position of the mat and apron connectors are optimized to provide a sufficient amount of tension on the mat while minimizing the torsional strain on the tube segment.

The support 12 is a continuous tube that includes a number of adjacent tube segments 36*a*-36*j* joined together. The continuous tube 12 includes walls extending down through the tube 12 at the union 34 of two adjacent tube segments 36*a*-36*j* to define the tube segments 36*a*-36*j* and to isolate the tube segments 36*a*-36*j* from one another. Alternatively, at least one passage can exist between at least two adjacent tube segments, e.g., to permit the flow of air there between, or the continuous tube 12 can be a single continuous segment. Examples of other useful tube and support constructions are described in U.S. Pat. No. 6,223,673 (Mears et al.) and U.S. Pat. No. 6,659,914 (Plante) and incorporated herein.

The apron 16 includes a number of segments 16*a*-16*j* bonded together to form a continuous apron 16. The union 40 between two apron segments 16 is formed by overlapping a portion of two adjacent apron segments 16 and attaching the segments together. The apron segments 16*a-j* include a sheet 42 folded over upon itself and attached to itself at 44. The apron 16 includes an optional extension 46 that results from the leading edge 58 of the sheet 42 being folded back over on itself and the apron connector 22 at a point beyond the weld 44 to form a second apron portion, i.e., the extension, 46. The extension 46 is positioned to sit under the apron connector 22 and to extend a distance along the exterior tube surface such that it extends to a point 58 beyond the point at which the end 30 the spring 24, or even the point at which the coiled portion 50 of the spring 24, would contact the support 12 if displaced downwardly toward the support 12 from its tensioned position. The first end 30 of the spring 24 that attaches or hooks around the triangle ring 32 of the apron connector 22 may contact the support 12 during use of the mat 18 or even while the mat 18 is taught. The apron extension 46 protects the support 12, i.e., the tube, from direct contact with the end 48 of the hook-shaped end 30, the body of the spring 24 or both. The apron extension 46 can protect the underlying tube 12 from wear and damage that might be caused by the contact between the hook 30, the coiled portion 50 of the spring 24, or both, and the support 12.

The trailing edge 52 of the sheet 42 that forms the apron 16 is fixed in position on the exterior surface 54 of the support 12 through weld 56. The apron segments 16*a*-16*j* are positioned on the tube segments 36*a*-36*j* such that the union 40 of two adjacent apron segments (e.g., 16*j* and 16*a*) corresponds to the union 68 of two adjacent tube segments (e.g., 36*j* and 36*a*). The apron segments 16*a*-16*j* are dimensioned to substantially conform to the general shape defined by the tube 12, the mat 18 or a combination thereof. For example, the tube contacting edge of the apron segment 16 preferably follows the general path, e.g., curvature, of the tube segment 36 in the area of contact between the apron segment 16 and the tube 12, and the apron connector 22 containing edge of the apron segment 16 preferably follows the general path of the side edge 38 of the mat 18 with which it is associated. For an apparatus having tube segments that are substantially straight and a mat with substantially straight sides, for example, the apron segments are preferably substantially straight. By conforming to the general path defined by the tube and the mat, the apron segments pull with a relatively uniform force on the mat and thereby enable the mat to be maintained generally flat, e.g., free of bulges, buckles and wrinkles.

The mat connectors 20 are preferably spaced at regular intervals along the edge 38 of the mat 18 to ensure that the force and tension exerted by the mat 18 and any force on the mat 18 or apron 16, e.g., a force due to a bouncing action on the mat surface and a force exerted by a spring 24 on the mat 18 or apron segments 16, pulls with a more uniform force on the apron and thereby enables the tube support 12 to be maintained in a generally standard configuration without being rotated inward toward the mat 18.

The apron 16 and the tube 12 can be made from the same or different material. Preferably the apron and the tube are capable of being bonded to each other by welding, e.g., thermal welding, but may be attached through various other mechanisms including e.g., other bonding methods including, e.g., sonic welding, adhesive composition and combinations thereof. Examples of useful apron and tube materials include thermoplastic resin impregnated woven webs including, e.g., polyvinyl or polyurethane impregnated woven webs (e.g., polyethylene and polyester woven webs). Preferably the tube material includes a woven web of polyester coated (e.g., impregnated) on two major surfaces with a polymer composition, e.g., polyvinyl chloride, to render the material air tight.

Various materials are suitable for mat 18 including, e.g., woven webs (e.g., polyethylene woven web), conventional trampoline mats and resilient webs. The mat is depicted as decagonal. Other useful mat shapes include, e.g., circle and any multi-sided polygon including, e.g., triangle, square, rectangle, pentagon, hexagon, heptagon, octagon, nonagon, hendecagon, dodecagon, tridecagon, and icosagon. The mat provides a surface on which a user can conduct a variety of activities including, e.g., sitting, bouncing, jumping and combinations thereof.

The trampoline is floatable on a body of water and also provides a deck surface for supporting human beings in a variety of activities including, e.g., sunning, resting, playing, and jumping.

The various components of the trampoline (e.g., the tube, the apron, the mat connectors, the apron connectors, the apron segments and the tube segments) have been described as being attached to each other through a thermal weld. Alternatively, the components are attached to each other using any suitable attachment mechanism including, e.g., other bonding methods (e.g., sonic welding, adhesive composition and combinations thereof), mechanical methods (e.g., stitching, stapling and mechanical fasteners including, e.g., grommets, snaps, buckles, and male-female connectors), and combinations thereof.

Figure 5:
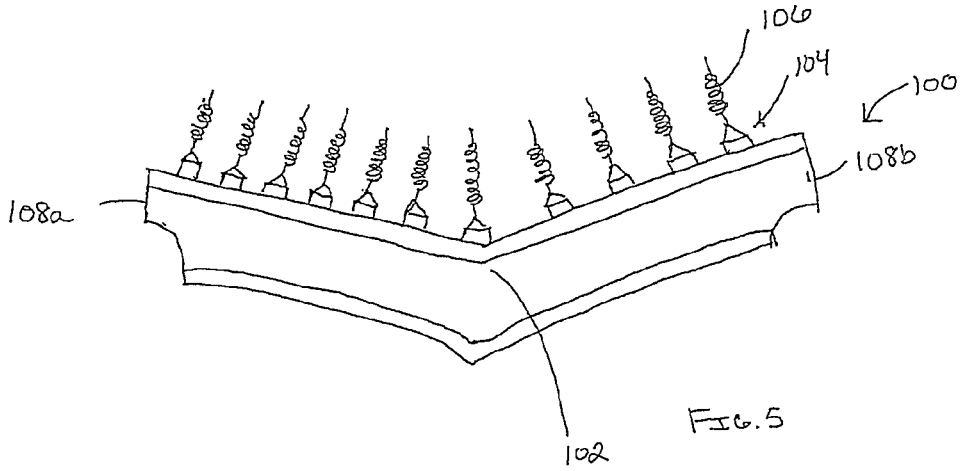
FIG. 5 is a perspective view of an apron according to another embodiment.
Figure 6:
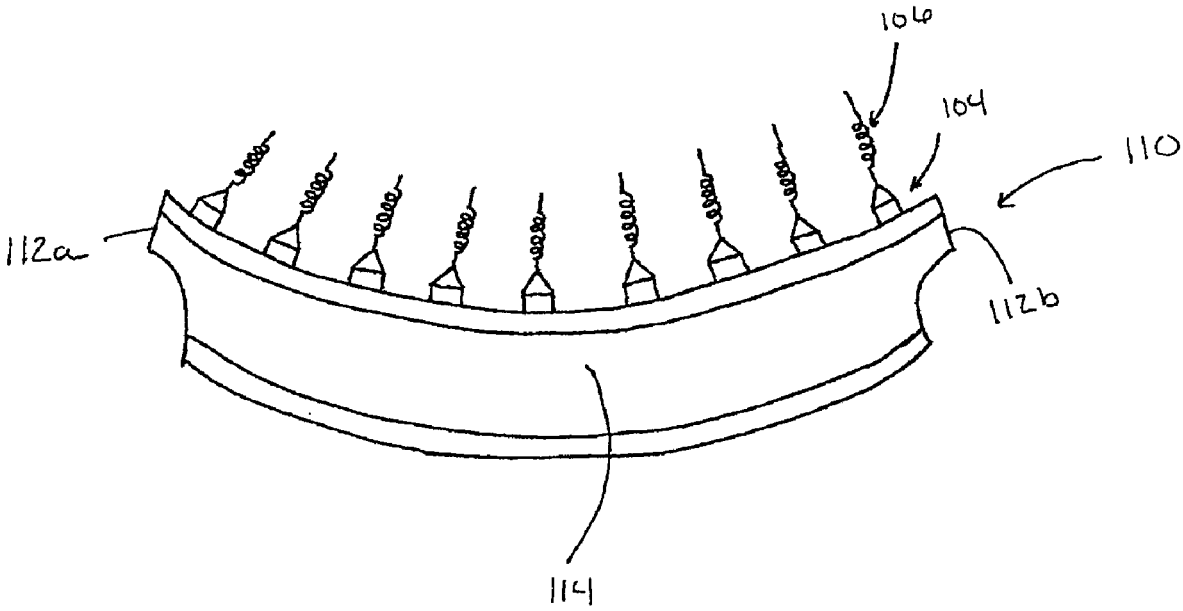
FIG. 6 is a perspective view of an apron according to another embodiment.

Other embodiments are within the claims. Although the support is depicted as exhibiting a generally decagonal shape, it may be of various shapes including, e.g., circle and polygon, e.g., triangle, square, rectangle, pentagon, hexagon, heptagon, octagon, nonagon, decagon, hendecagon, dodecagon, tridecagon, and icosagon. The apparatus can also include an encasement, e.g., a polyvinylchloride impregnated woven fabric, surrounding the tube 12 or tube segments. Although the apron segments have been shown as generally rectangular, they can be constructed in any suitable manner and exhibit any suitable shape to enable connectors for receiving a spring end to be attached to the tube. FIG. 5 illustrates an embodiment of an apron 100 that includes a v-shaped portion 102 and apron connectors 104 positioned at intervals along the edge of the apron 100. The apron connectors 104 are coupled to the mat connectors (not shown), through springs 106. FIG. 6 illustrates a curved embodiment of an apron 110 in which the apron 110 is in the general shape of an arc. Apron connectors 104 are positioned at uniform intervals along the edge of the apron 110 and receive the hook end of a spring 106. Aprons of FIGS. 5 and 6, when coupled to a linear side of a trampoline mat such as the one illustrated in FIG. 2, create a greater distance between the mat and the apron at the center (102, 114) of the apron relative to the ends 108*a*, 108*b* and 112*a*, 112*b*) of the apron. Such a construction can be used to more evenly distribute the tension across all of the springs that connect between the mat and the apron.

Figure 8:
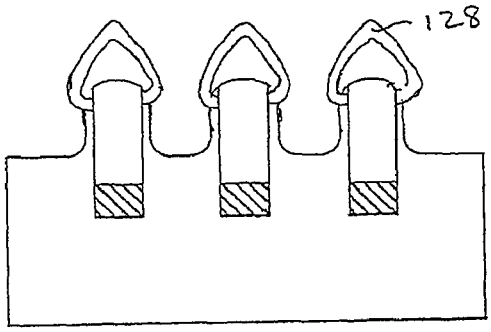
FIG. 8 is a plan view of the back of a portion of the apron of FIG. 7.
Figure 9:
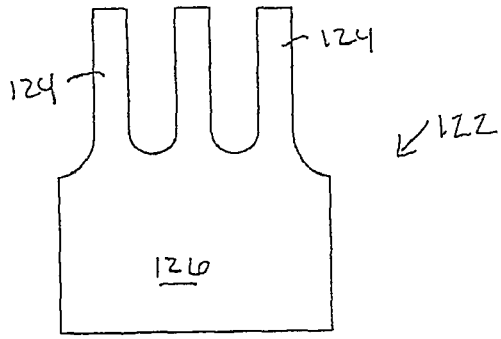
FIG. 9 is a plan view of an unfolded sheet that forms the apron of FIG. 7.
Figure 7:
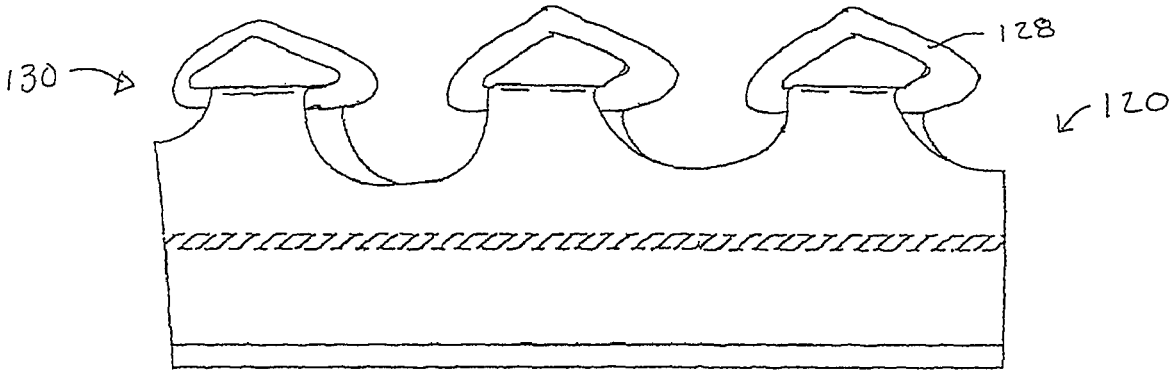
FIG. 7 is a perspective view of a portion of the top of an apron according to another embodiment.
Figure 11:
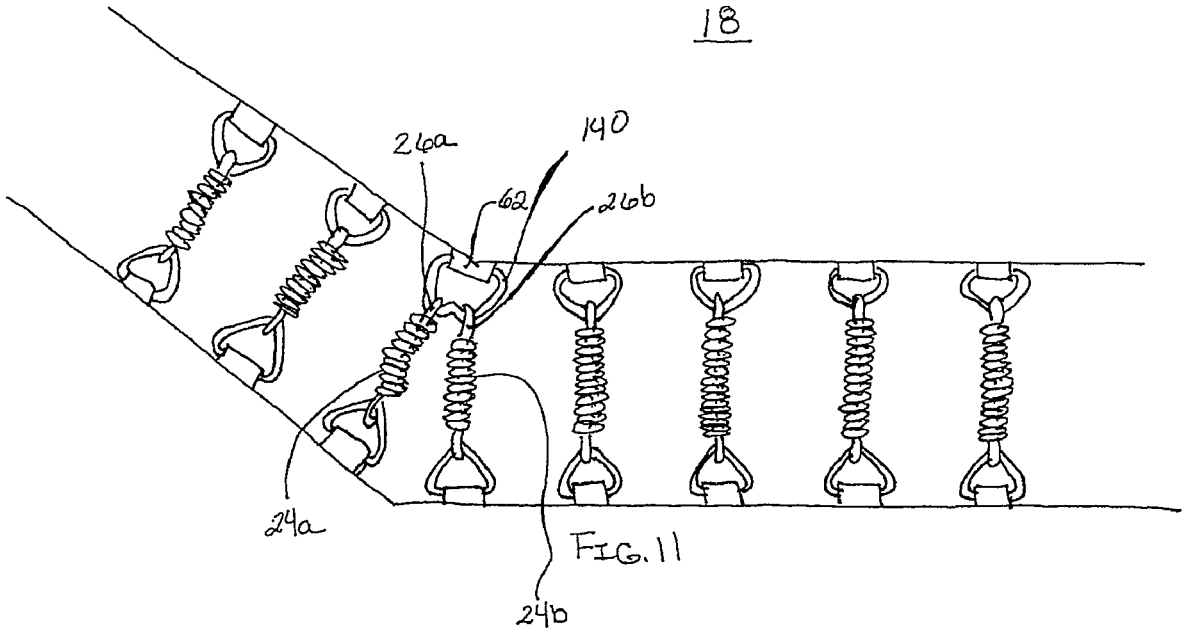
FIG. 11 is a top view of a connection between an apron and a mat of a trampoline according to another embodiment.

FIGS. 7-9 illustrate an embodiment of the apron 120 that is formed from a sheet 122 that includes individual, spaced apart strips 124. The strips 124 extend from a base portion 126 of the sheet 122. The individual strips 124 are threaded through a triangle ring 128 and then folded over upon themselves and attached to the base portion 126 of the sheet (e.g., through a weld) to form the apron connectors 130 for receiving the end of the spring.

Although the support has been described as a tube, it could also be made from any suitable material that floats including, e.g., foam. The rings, which have been described as triangular, can define of a variety of shapes including, e.g., polygonal (e.g., rectangular and square), letter-shaped including, e.g., D-shaped, W-shaped, X-shaped, B-shaped, M-shaped, N-shaped, P-shaped, R-shaped, T-shaped, S-shaped, U-shaped, and Z-shaped, number-shaped including, e.g., number eight, number six, and number seven, circular, elliptical, oval, and combinations thereof The rings can be made of a variety of materials including, e.g., metal (e.g., iron, steel, nickel, aluminium, titanium, copper, zinc and combinations thereof), graphite, carbide, polymer (e.g., plastic, thermoplastic elastomer, and rubber), and composites and combinations thereof. The ring can be continuous or discontinuous, e.g., a continuous loop or a discontinuous loop, and can include combinations thereof.

Figure 10:
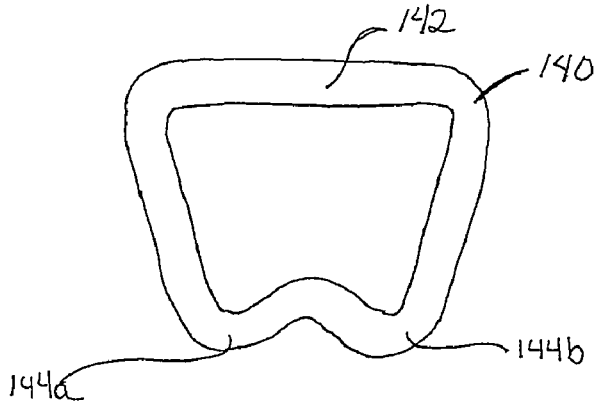
FIG. 10 is a plan view of a W-shaped ring according to one embodiment.

FIG. 10 illustrates a W-shaped ring 140 that includes a continuous loop that includes a linear section 142 and two peaks 144*a* and 144*b* that are dimensioned to received hook-shaped ends 26*a*, 26*b* of springs 24*a* and 24*b*. The loop is welded together to form a continuous loop. The strap 62 of the mat 18 threads through the W-shaped ring 140 and around linear section 142.

In other embodiments, the trampoline is coupled to other floatable articles, which can have a variety of shapes and sizes including, e.g., log, bounce apparatus, pillow, slide, rope swing, tube, animal-shaped, monster-shaped, alien-shaped, towable, and combinations thereof. The floatable articles can be inflatable. Examples of useful floatable articles are described in U.S. Pat. No. 6,223,673 (Mears et al.) and incorporated herein.

What is claimed is:

1. A floatable trampoline comprising:

a floatable support defining an opening;

an apron bonded to the floatable support;

a mat extending across the opening;

a plurality of first connectors attached to the mat;

a plurality of second connectors attached to the apron; and a plurality of springs, wherein the plurality of springs are attached to the plurality of first connectors and second connectors so as to couple the mat to the apron.

2. The floatable trampoline of claim 1, wherein said trampoline is free of a rigid, metal frame.

3. The floatable trampoline of claim 1, wherein at least one of said first connectors comprises a W-shaped ring.

4. The floatable trampoline of claim 1, wherein the mat comprises at least one corner and at least one first connector is attached to the at least one mat corner and the at least one first connector attached to the at least one mat corner is in the shape of a W.

5. The floatable trampoline of claim 1, wherein said floatable support is inflatable.

6. The floatable trampoline of claim 1, further comprising:

a first loop extending from the mat and wrapping around one of the first connectors; and a second loop extending from the apron and wrapping around one of the second connectors.

7. A method of constructing the floatable trampoline of claim 1 said method comprising:

connecting at least one of the springs to the mat; and connecting the at least one spring to the floatable support.

8. The floatable trampoline of claim 5, wherein said trampoline is free of a rigid, metal frame.

9. The floatable trampoline of claim 5, wherein at least one of said first connectors comprises a W-shaped ring.

10. The floatable trampoline of claim 5, wherein the mat comprises at least one corner and at least one of the first connectors is attached to the at least one mat corner and the at least one first connector attached to the at least one mat corner is in the shape of a W.

11. The floatable trampoline of claim 1, further comprising:

a first loop extending from the mat and wrapping around one of the first connectors; and a second loop extending from the apron and wrapping around one of the second connectors.

12. The floatable trampoline of claim 1, wherein the apron comprises a first end and a second end, the second connectors being attached to the first end of the apron, and the second end of the apron being attached to the floatable support.

13. A method of constructing the floatable trampoline of claim 1, said method comprising:

connecting at least one of the springs to the mat; and connecting the at least one spring to at least one second connector, the apron comprising a first end and a second end, the first end being attached to the at least one second connector and the second end being attached to the floatable support.

* * * * *